US007731635B2

(12) United States Patent
Dyer

(10) Patent No.: US 7,731,635 B2
(45) Date of Patent: Jun. 8, 2010

(54) CROSS TRAINING EXERCISE DEVICE

(75) Inventor: David E. Dyer, Renton, WA (US)

(73) Assignee: Precor Incorporated, Woodinville, WA (US)

( * ) Notice: Subject to any disclaimer, the term of this patent is extended or adjusted under 35 U.S.C. 154(b) by 1059 days.

(21) Appl. No.: 11/342,916

(22) Filed: Jan. 30, 2006

(65) Prior Publication Data

US 2007/0179023 A1 Aug. 2, 2007

(51) Int. Cl.
*A63B 22/04* (2006.01)

(52) U.S. Cl. ..... 482/52; 482/57; 482/70

(58) Field of Classification Search ..... 482/51, 482/52, 53, 57, 70, 79, 80, 56, 148, 908, 482/62

See application file for complete search history.

(56) References Cited

U.S. PATENT DOCUMENTS

| | | | | | |
|---|---|---|---|---|---|
| 5,299,993 | A | | 4/1994 | Habing | 482/52 |
| 5,577,985 | A | * | 11/1996 | Miller | 482/52 |
| 5,707,321 | A | * | 1/1998 | Maresh | 482/57 |
| 5,735,773 | A | | 4/1998 | Vittone | 482/52 |
| 5,788,610 | A | * | 8/1998 | Eschenbach | 482/52 |
| 5,893,820 | A | | 4/1999 | Maresh et al. | 482/51 |
| 5,916,065 | A | | 6/1999 | McBride et al. | 482/57 |
| 5,997,445 | A | * | 12/1999 | Maresh et al. | 482/70 |
| 6,042,512 | A | * | 3/2000 | Eschenbach | 482/52 |
| 6,146,313 | A | * | 11/2000 | Whan-Tong et al. | 482/51 |
| 6,168,552 | B1 | * | 1/2001 | Eschenbach | 482/52 |
| 6,171,215 | B1 | * | 1/2001 | Stearns et al. | 482/51 |
| 6,196,948 | B1 | * | 3/2001 | Stearns et al. | 482/52 |
| 6,416,442 | B1 | * | 7/2002 | Stearns et al. | 482/57 |
| 6,422,977 | B1 | | 7/2002 | Eschenbach | 482/52 |
| 6,436,007 | B1 | * | 8/2002 | Eschenbach | 482/52 |
| 6,440,042 | B2 | * | 8/2002 | Eschenbach | 482/52 |
| 6,551,218 | B2 | | 4/2003 | Goh | 482/52 |
| 6,802,797 | B2 | | 10/2004 | Maresh | 482/57 |
| 6,846,273 | B1 | * | 1/2005 | Stearns et al. | 482/52 |
| 7,025,711 | B2 | * | 4/2006 | Eschenbach | 482/52 |
| 7,060,005 | B2 | * | 6/2006 | Carlsen et al. | 482/52 |
| 7,494,449 | B2 | * | 2/2009 | Eschenbach | 482/52 |
| 2001/0051562 | A1 | | 12/2001 | Stearns et al. | 482/51 |
| 2002/0123412 | A1 | | 9/2002 | Nguyen | 482/57 |
| 2003/0083177 | A1 | * | 5/2003 | Tung | 482/51 |

* cited by examiner

*Primary Examiner*—Loan H Thanh
*Assistant Examiner*—Tam Nguyen
(74) *Attorney, Agent, or Firm*—Terence P. O'Brien; Todd R. Rathe; Paul E. Schaafsma

(57) ABSTRACT

An exercise device includes a frame, a pair of foot supports, and at least one four-bar linkage assembly coupled to the frame. The at least one linkage assembly is coupled to at least one of the foot supports. The four-bar linkage assembly directs the foot support in a generally elliptical motion while in use. The generally elliptical motion defines a major dimension extending at an angle from horizontal that is within the range of about thirty degrees (30°) to about seventy-five degrees (75°) and the major dimension having a length that is within the range of about ten inches to about eighteen inches.

19 Claims, 8 Drawing Sheets

CROSS TRAINING EXERCISE DEVICE

FIELD OF THE INVENTION

The present invention relates to exercise equipment.

BACKGROUND OF THE INVENTION

The benefits of regular aerobic exercise have been well established and accepted. However, due to time constraints, inclement weather, and other reasons, many people are prevented from outdoor aerobic activities such as walking, jogging, running, and swimming. As a result, a variety of indoor exercise equipment has been developed for aerobic activity. It is generally desirable to exercise a large number of different muscles over a significantly large range of motion so as to provide for balanced physical development, to maximize muscle length and flexibility, and to achieve optimum levels of aerobic exercise. It is further advantageous for exercise equipment to provide smooth and natural motion, thus avoiding significant jarring and strain that can damage both muscles and joints.

While various exercise systems are known in the prior art, these systems suffer from a variety of shortcomings that limit their benefits and/or include unnecessary risks and undesirable features. For example, stationary bicycles are a popular exercise system in the prior art; however, these machines employ a sitting position that utilizes only a relatively small number of muscles, through a fairly limited range of motion. Cross-country skiing exercise devices are also utilized to simulate the gliding motion of cross-country skiing. While cross-country skiing devices exercise more muscles than stationary bicycles, the substantially flat shuffling foot motion provided by the ski devices limits the range of motion of some of the muscles being exercised. Treadmills are still a further type of exercise device in the prior art. Treadmills allow natural walking or jogging motions in a relatively limited area. A drawback of the treadmill, however, is that significant jarring of the hip, knee, ankle, and other joints of the body may occur through use of this device.

Another type of exercise device simulates stair climbing. Such devices can be composed of foot levers that are pivotally mounted to a frame at their forward ends and have foot-receiving pads at their rearward ends. The user pushes his/her feet down against the foot levers to simulate stair climbing. Resistance to the downward movement of the foot levers is provided by springs, fluid shock absorbers and/or other elements. These devices exercise more muscles than stationary bicycles; however, the rather limited range of up-and-down motion utilized does not necessarily exercise the user's leg muscles through a large range of motion. Further, the substantially vertical reciprocating motion of such stair climbing exercise machines can result in the application of undesirable impact loads to the hips, knees, and ankles of the user. In addition, the up and down reciprocating motion can induce a hyperextension of the knee. One attempt to reduce such loads in the prior art includes adding cushioning to the pedals of the stair climbing exercise machines.

Another drawback of existing stair climbing exercise machines is that such machines enable a user to take very small rapid steps during use. Such motion does not take the larger leg and gluteus muscles through large enough displacement to result in a significant cardio exercise. Rather, such smaller, faster stepping motions focus more on the generally undesirable anaerobic power system and not the desired aerobic endurance system.

A further limitation of a majority of exercise systems in the prior art lies in the limited types of motions that they can produce. A relatively new class of exercise devices is capable of producing generally elliptical motion that better simulates the natural stride of a person. Such exercise systems create elliptical motion, as referred to herein, when the path traveled by a user's feet while using the exercise system follows a generally ellipse-shaped path of travel. Elliptical motion is much more natural and analogous to running, jogging, and walking than the linear-type, back and forth motions produced by some prior art exercise equipment; however, devices that create an elliptical motion are generally limited to analogizing to running, jogging, and walking motions.

What would thus be desirable is an exercise device that provides for smooth natural action and exercises a relatively large number of muscles through a large range of motion. It would be further desirable for an exercise device to produce a user selectable raised, or highly angled, generally elliptical motion that simulates natural climbing or stepping motion. It would be further desirable for an exercise device to provide a relatively higher Relative Perceived Exertion (RPE) relative to the elliptical machines of the prior art. It would be further desirable for an exercise device to exercise muscles that are not exercised by elliptical machines of the prior art. It would also be advantageous to provide an exercise machine that allows for simulation of a stepping or climbing motion without allowing for the use of undesirable small rapid stepping movements.

SUMMARY OF THE INVENTION

An exercise device in accordance with the principles of the present invention provides for smooth natural action and exercises a relatively large number of muscles through a large range of motion. An exercise device in accordance with the principles of the present invention produces a user selectable raised, or highly angled, generally elliptical motion that simulates natural climbing or stepping motion. An exercise device in accordance with the principles of the present invention provides a relatively higher Relative Perceived Exertion (RPE) relative to the elliptical machines of the prior art. An exercise device in accordance with the principles of the present invention exercises muscles that are not exercised by elliptical machines of the prior art.

An exercise device in accordance with the principles of the present invention includes a four-bar link that provides a foot-supporting portion with a generally elliptical motion. The four-bar link can comprise a main crank arm, a secondary crank arm, and a connecting link. The connecting link can be pivotally connected to the foot-supporting portion, and the connecting link can be pivotally connected to the main crank arm and the secondary crank arm. An end of the secondary crank arm opposite the pivotal connection with the connecting link establishes a ground point connection to a main frame.

A lift arm can be connected to the ground point of the secondary crank arm. The lift arm can be further connected to a lift actuator such that as the lift actuator is enabled, the location of the ground point of the secondary crank arm changes. By changing the location of the ground point of the secondary crank arm, the angle of the generally elliptical path of the foot-supporting portion can be altered, which also varies the stride length. Thus, an exercise device in accordance with the principles of the present invention provides a generally elliptical motion at an angle from horizontal of about thirty degrees (30°) to about seventy-five degrees (75°) and a length of stride of about ten (10) inches to about eighteen (18) inches.

BRIEF DESCRIPTION OF THE DRAWINGS

The foregoing aspects and many of the advantages of the present invention will be more readily appreciated as the same becomes better understood by reference to the following detailed description, when taken in conjunction with the accompanying drawings, wherein.

DETAILED DESCRIPTION OF THE PREFERRED EMBODIMENT

In conventional prior art devices designed to simulate walking, jogging or running activity, the major or longitudinal dimension of the cyclical or closed path of the user's foot produced by the exercise machine during use is typically oriented at a fixed position between about a zero degree (0°) to about a thirty degree (30°) angle from horizontal. Such exercise devices also typically produce a fixed stride length of about eighteen (18) inches. This orientation provides for acceptable walking, jogging, and running simulation; however, such devices cannot produce a suitable climbing motion and cannot simulate a suitable steep uphill walking, jogging or running motion. A user interested in simulating a climbing motion, or a steep uphill walking, jogging or running motion, is limited to utilizing exercise devices that produce a substantially up and down reciprocating motion. Such reciprocating motion can result in undesirable stress on the joints of the user, and such motion does not simulate a natural climbing motion. Thus, existing exercise devices typically do not provide a means for simulating a steep uphill walking, jogging or running motion, or a non-reciprocating climbing motion.

An exercise device in accordance with the principles of the present invention simulates a wide range of generally elliptical motions, including climbing, and steep uphill walking, jogging or running motions. The exercise device of the present invention is not limited to a fixed up-and-down reciprocating motion; rather, an exercise device of the present invention exercises the user's leg muscles through a larger range of motion. Also, an exercise device in accordance with the present invention substantially reduces the undesirable stress on the joints of a user. In addition, a typical elliptical exercise device of the prior art provides a Relative Perceived Exertion (RPE) that is low relative to a typical stair climber of the prior art. An exercise device in accordance with the present invention provides a relatively higher Relative Perceived Exertion (RPE) relative to the elliptical machines of the prior art without the attendant drawbacks of the stair climber devices of the prior art. Further, the exercise device of the present invention does not enable a user to employ undesirable small rapid stepping motions when operating the device. Rather the exercise device of the present invention provides the user with a large variety of motions simulating climbing or stepping motions which take the user's leg and gluteus muscles through a large range of displacement thereby providing a significant cardio vascular exercise.

Figure 1:
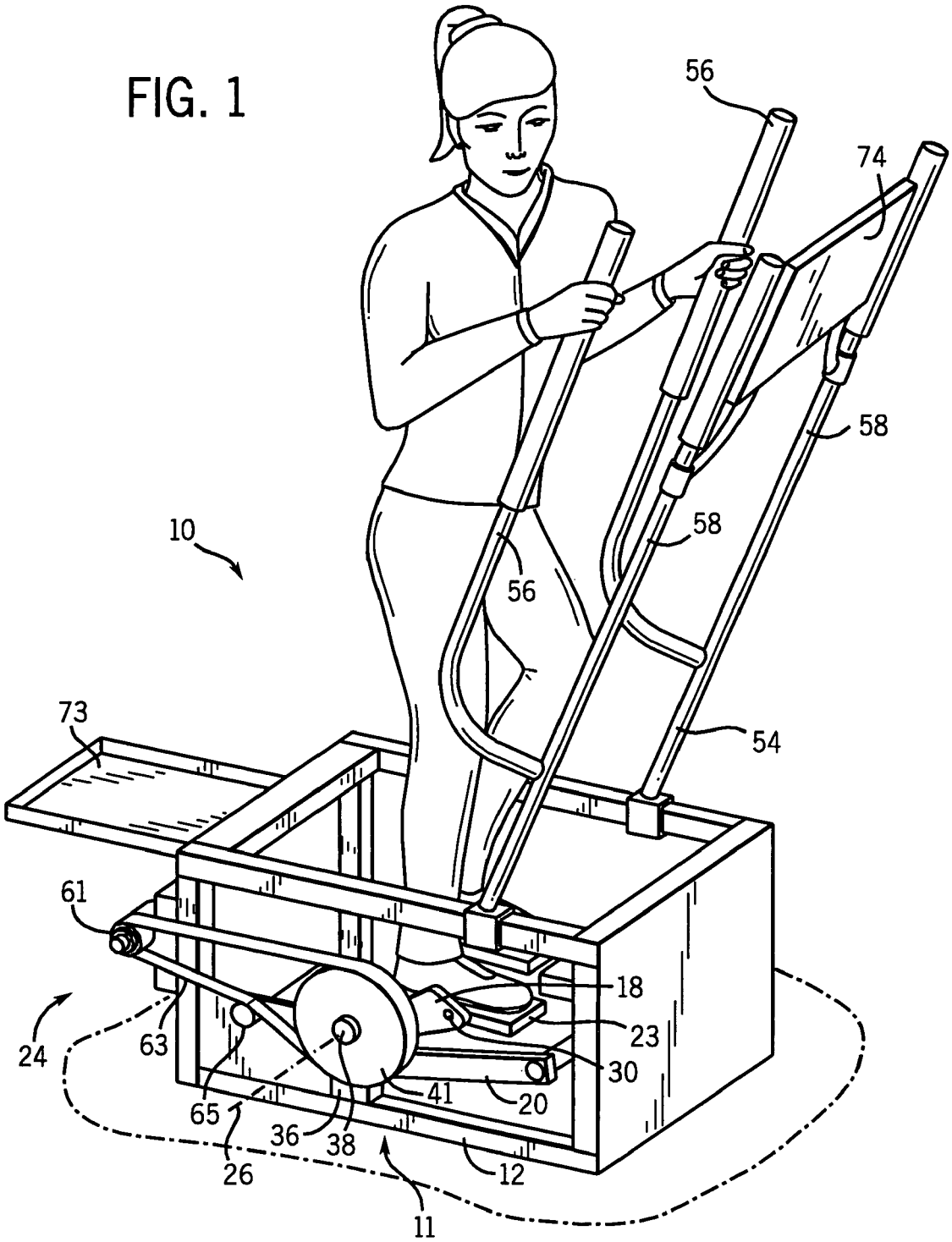
FIG. 1 is a perspective view of a user on an exercise device in accordance with the principles of the present invention.
Figure 2:
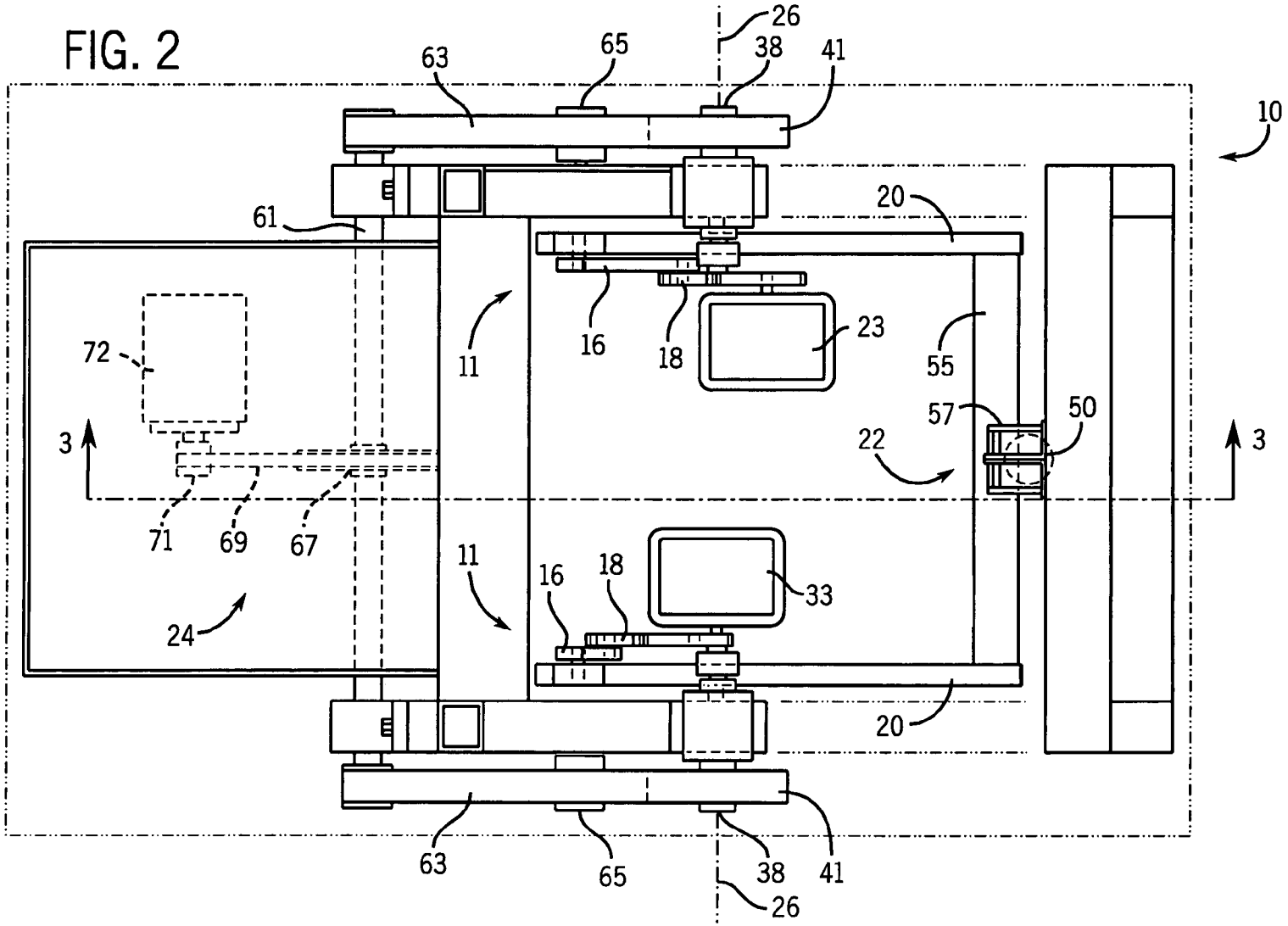
FIG. 2 is an overhead view of the device of FIG. 1.
Figure 3:
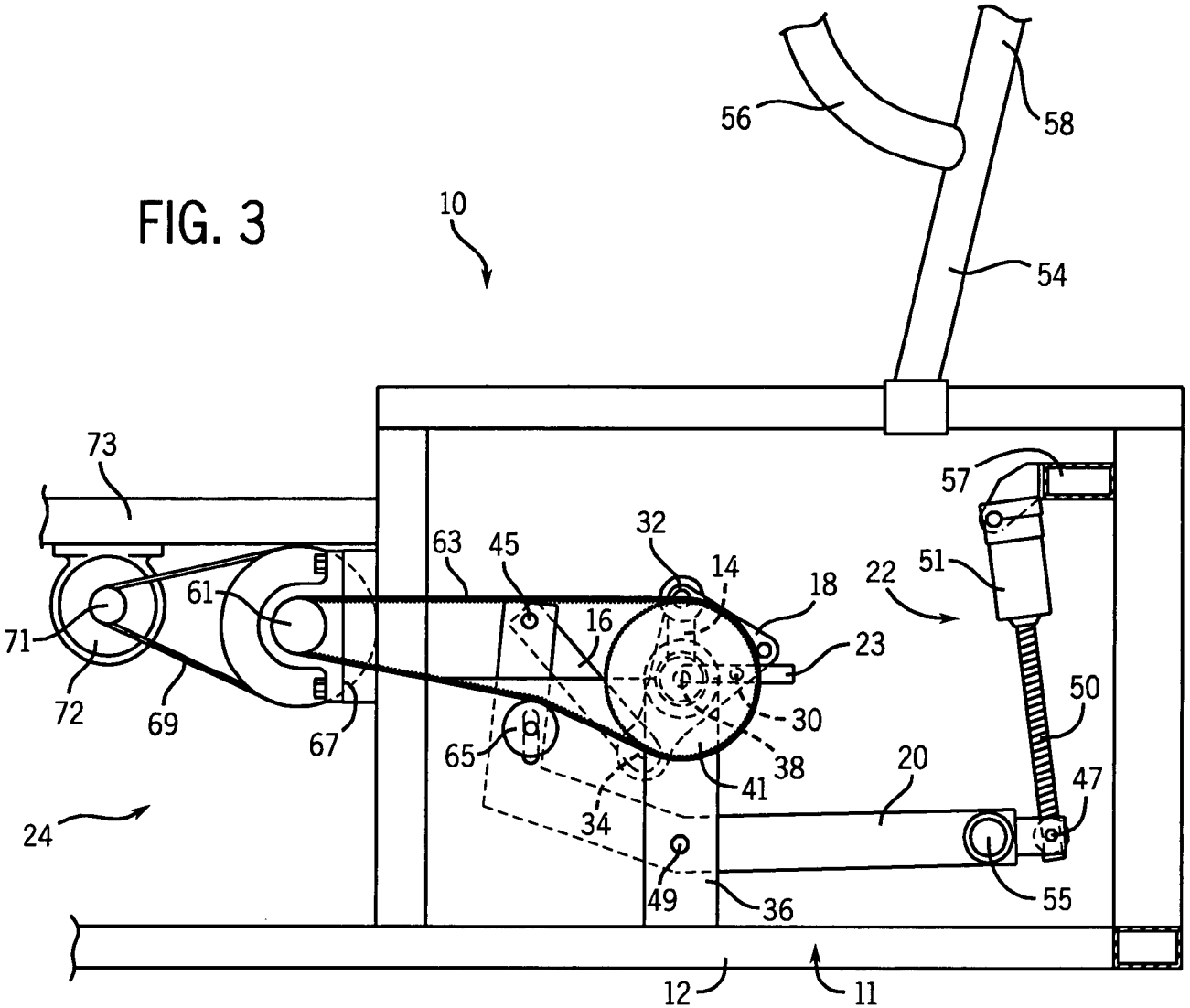
FIG. 3 is an elevated side view of the device taken along line 3-3 of FIG. 2.

Referring initially to FIGS. 1-3, an exercise device 10 in accordance with the principles of the present invention is seen. The exercise device of the present invention includes a pair of four-bar linkage assemblies 11 corresponding to the left and right legs of a user (best seen in FIG. 2). For ease of description, a single four-bar linkage assembly is primarily described herein. The exercise device 10 also can include a main frame 12, a lift mechanism 22, a load application assembly 24, and a display panel 74. The frame 12 is configured to be supported on a floor and operably supports the remaining components of the exercise device 10. Ideally, but not essentially, the main frame 12 can be composed of rectangular tubular members, which can be relatively light in weight but provide substantial strength. Other frame configurations can also be used. The frame 12 includes a pair of upwardly extending axle mounts 36 supporting a transverse axle 38 along a first pivot axis 26. The transverse axle 38 can preferably be operatively connected to a flywheel 41, as described in detail below. A bearing assembly can be employed to anti-frictionally mount the transverse axle 38 to the axle mounts 36.

In one preferred embodiment, the frame further includes first and second upper body supports 54 for grasping by a user while utilizing the present device. Each upper body support 54 can include a proximal arm support 56 and a distal arm support 58, with the proximal arm support 56 positioned closer to the user relative to the distal arm support 58 to provide the user with a choice of which support (if any) to utilize. The arm supports 56, 58 can be securely attached to main frame 12 by any expedient manner, such as by welding or bolting. The arm supports 56, 58 may be in part or in whole covered by a gripping material or surface, such as tape, foamed synthetic rubber, etc. Other upper body support configurations can also be used, including a single arm support for each arm, and various other handlebar shapes. In another embodiment, the upper body supports can be pivotally coupled to the frame thereby serving as movable arm links and enabling the user to engage in a total body exercise routine. In yet another embodiment, the upper body supports can be pivotally coupled to the frame and to the four-bar linkage assembly thereby providing coordinated movable arm links.

The display panel 74 can be mounted on the arm support 54, at an orientation that can be easily viewable to a user. Alternatively, the display panel can be coupled to the frame using other conventional approaches. Instructions for operating the device as well as courses being traveled may be located on the display panel 74. In some embodiments of the present invention, electronic devices may be incorporated into the exercise device such as for example timers, odometers, speedometers, heart rate indicators, energy expenditure recorders, controllers, etc. This information may be routed through a central processing unit (CPU) to the display panel 74 for ease of viewing for a user of the device.

Referring to FIGS. 4-7, elevated side views of the device of FIG. 1 are seen with certain elements omitted for ease of reference; thus, FIGS. 4-7 illustrate the four-bar linkage 11 in greater detail. In addition to the frame 12, the four-bar linkage 11 comprises a main crank arm 14, a secondary crank arm 16, a foot link 18, and a positioning link 20. The main crank arm 14 can be pivotally connected at a first end to the transverse axle 38 and can be pivotally connected at a second end to the foot link 18 at main crank pivot 32. The foot link 18 can pivotally connect the main crank arm 14 (main crank pivot 32) to the secondary crank arm 16 at secondary crank pivot 34.

Additionally, the foot link 18 can provide a footpad pivot 30 that pivotally supports a foot pedal or pad (hereinafter referred to as footpad 23). The footpad 23 outwardly extends from the footpad pivot 30, and can include a generally planar upper surface for receiving and supporting at least a portion of the foot of a user. The footpad 23 can be pivotally mounted such that the footpad remains in a generally horizontal position as the footpad 23 travels about its generally elliptical path of travel. Alternatively, the footpad 23 can be pivotally coupled such that the footpad is free to rotate about a generally horizontal axis extending through the footpad pivot 30, in a manner equivalent to a bicycle pedal. Alternatively, the footpad 23 can be pivotally mounted such that the footpad follows a controlled angle relative to horizontal throughout the foot travel to simulate ankle positions normally seen while running or walking as the footpad 23 travels about its generally elliptical path of travel. In addition, the location where the footpads 23 are connected to the foot link 18 by the footpad pivot 30 can be altered by, for example, providing multiple apertures (or connection points 35) into which the footpad pivot 30 can be mounted. Depending on where the footpads 23 are connected to the foot link 18 by the footpad pivot 30, the shape of the elliptical path taken by the footpad 23 during use can be altered.

Figure 4:
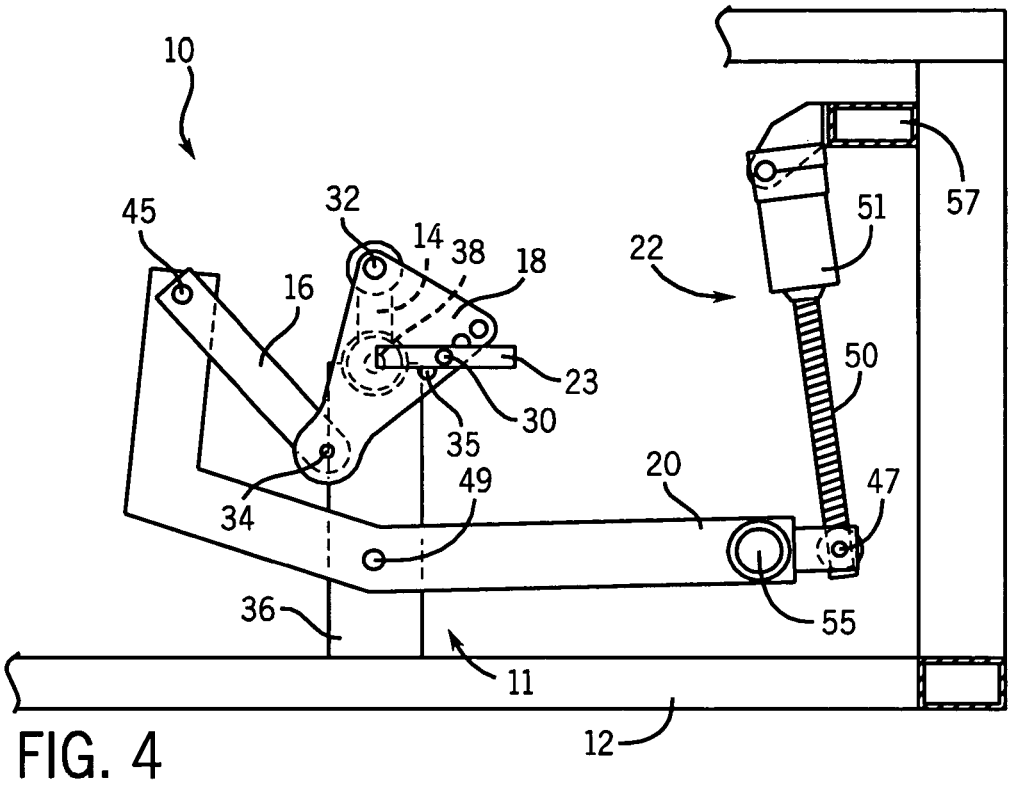
FIG. 4 is an elevated side view of the device of FIG. 1 in a first position with certain elements omitted for ease of reference.
Figure 5:
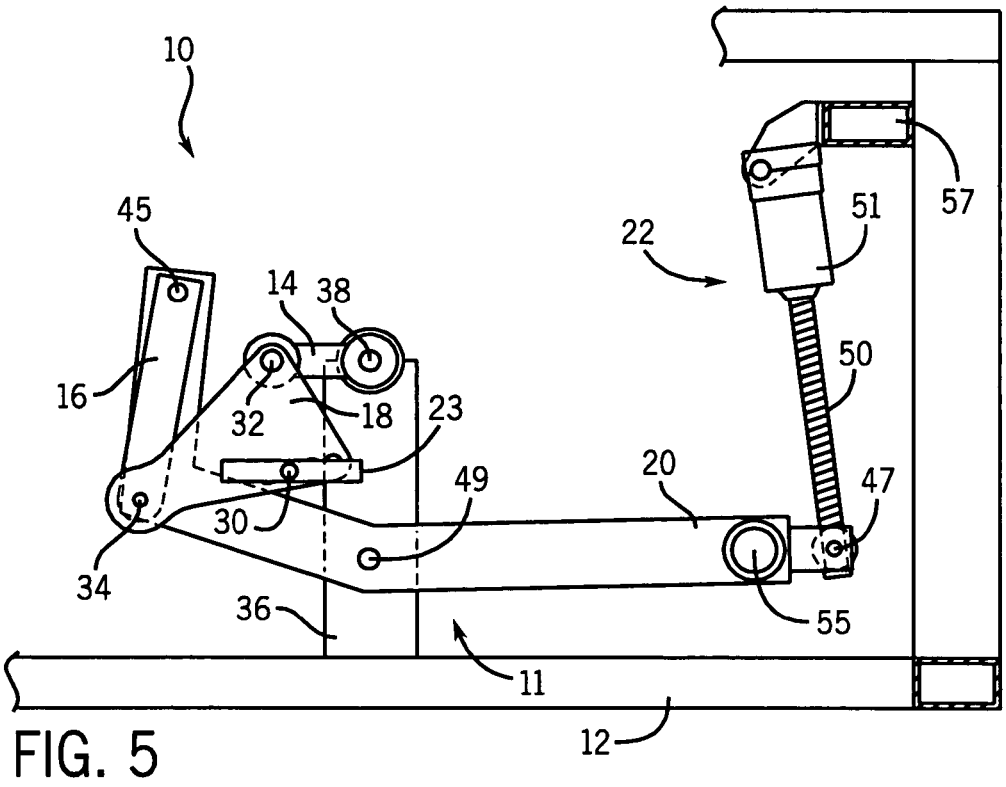
FIG. 5 is an elevated side view of the device of FIG. 1 in a second position with certain elements omitted for ease of reference.
Figure 6:
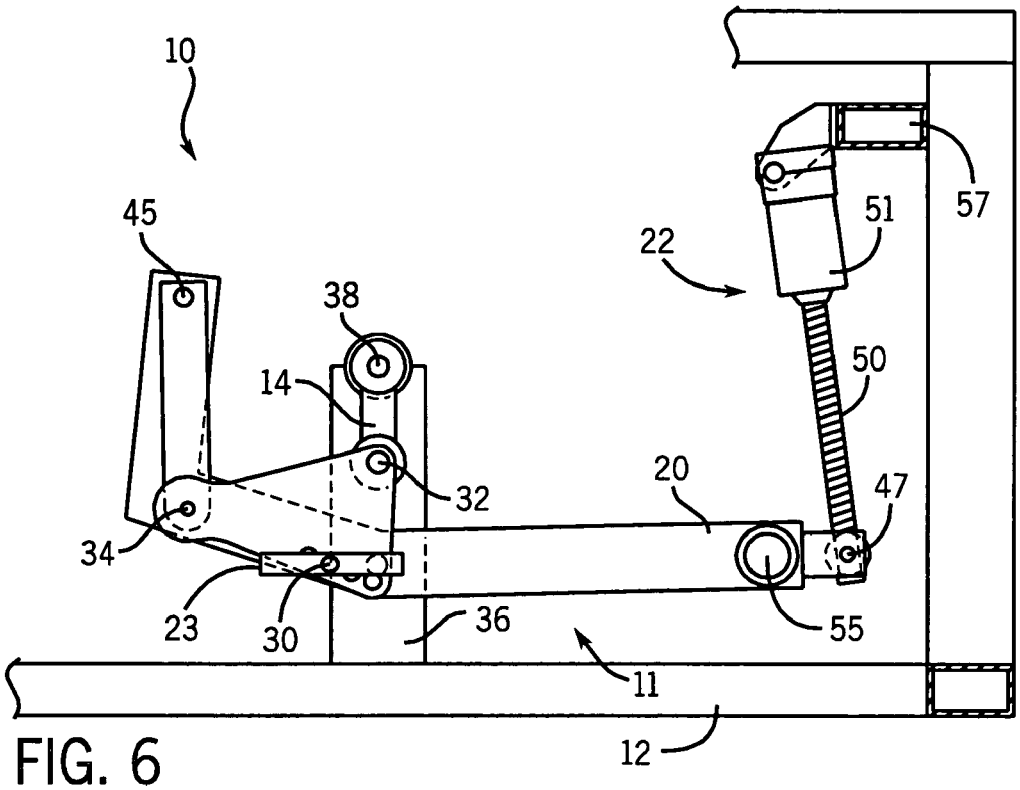
FIG. 6 is an elevated side view of the device of FIG. 1 in a third position with certain elements omitted for ease of reference.
Figure 7:
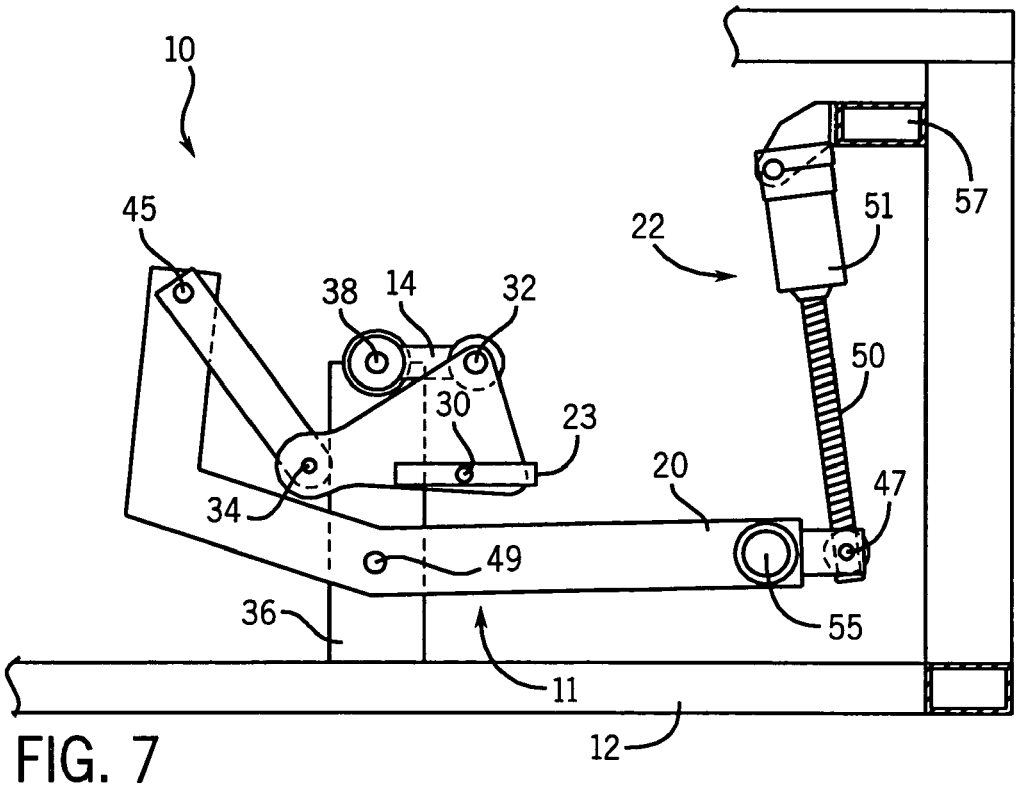
FIG. 7 is an elevated side view of the device of FIG. 1 in a fourth position with certain elements omitted for ease of reference.

More specifically, in one embodiment, the main crank pivot 32 and the secondary crank pivot 34 are collinear with respect to each other, and the footpad pivot 30 is spaced apart, in a non-collinear manner, from the main crank pivot 32 and the secondary crank pivot 34. The main crank pivot 32, the secondary crank pivot 34 and the footpad pivot 30 are preferably coplanar with respect to each other. Referring to FIG. 4, in one embodiment, the foot link 18 can include two or more connection points 35 for positioning of the footpad pivot 30. The connection points 35 can be used to adjust the position of the footpad pivot 30 with respect to the main crank pivot 32 and the secondary crank pivot 34. Repositioning or relocation of the footpad pivot 30 with the connection points 35 can be performed manually or through remote means, such as, for example, a servo-motor, an actuator other conventional mechanism. Repositioning of the footpad pivot 30 enables the generally elliptical shape and size of the footpad 23 path to be adjusted. Alternatively, the repositioning of the footpad pivot 30 on the foot link 18 can be accomplished through other means, such as, for example, a slidable slotted connection.

The end of the secondary crank arm 16 opposite the secondary crank pivot 34 can be pivotally connected to a first end of the positioning link 20 at lift pivot 45, thereby establishing a ground point connection to the main frame 12. The opposite second end of the positioning link 20 can be coupled to the lift mechanism 22. A central portion of the positioning link 20 can be pivotally coupled at central pivot axis 49 to the frame 12, such that movement of second end of the positioning link 20 via operation of the lift mechanism 22 results in the raising or lowering of lift pivot 45 at the first end of the positioning link 20 thereby varying the position of the ground point connection to the main frame 12.

The lift mechanism 22 can be provided to alter the angle of the major dimension of the generally elliptical path of the footpad 23 with respect to horizontal. The lift mechanism 22 can include a threaded drive shaft 50 and an actuator 51. The second end of the positioning link 20 can include a threaded collar 47 coupling the positioning link 20 to the drive shaft 50 of the lift mechanism 22. The threaded collar 47 operably engages the drive shaft 50 and is configured to ride up and down the drive shaft 50 in response to movement of the actuator 51. The actuator 51 can include an electric motor operably connected to the upper portion of the screw section 50 and pivotally mounted to the frame 12 by a mounting 57. The actuator 51 may be operable to rotate the screw section 50 in one direction to lower the threaded collar 47 or in the opposite direction to raise the threaded collar 47, as desired. The upward or downward movement of the threaded collar 47 produces a corresponding downward or upward movement of the lift pivot 45 at the first end of the positioning link 20, respectively. By changing the location of the lift pivot 45, the pivot location of the secondary crank arm 16 changes, and the angle of the major dimension of the generally elliptical path of the footpads 23 with respect to horizontal can be altered. The repositioning of the lift pivot 45 can also result in a change to the stride length of the footpads 23 during use.

In alternative embodiments, the lift pivot 45 of the positioning link 20 can be raised and lowered by various mechanisms, both manual and automatic. In one embodiment, the lift pivot 45 can be raised and lowered by hydraulics or pneumatics. In another embodiment, the lift pivot can be raised and lowered by other forms of conventional linkage and/or drive mechanisms.

Figure 8:
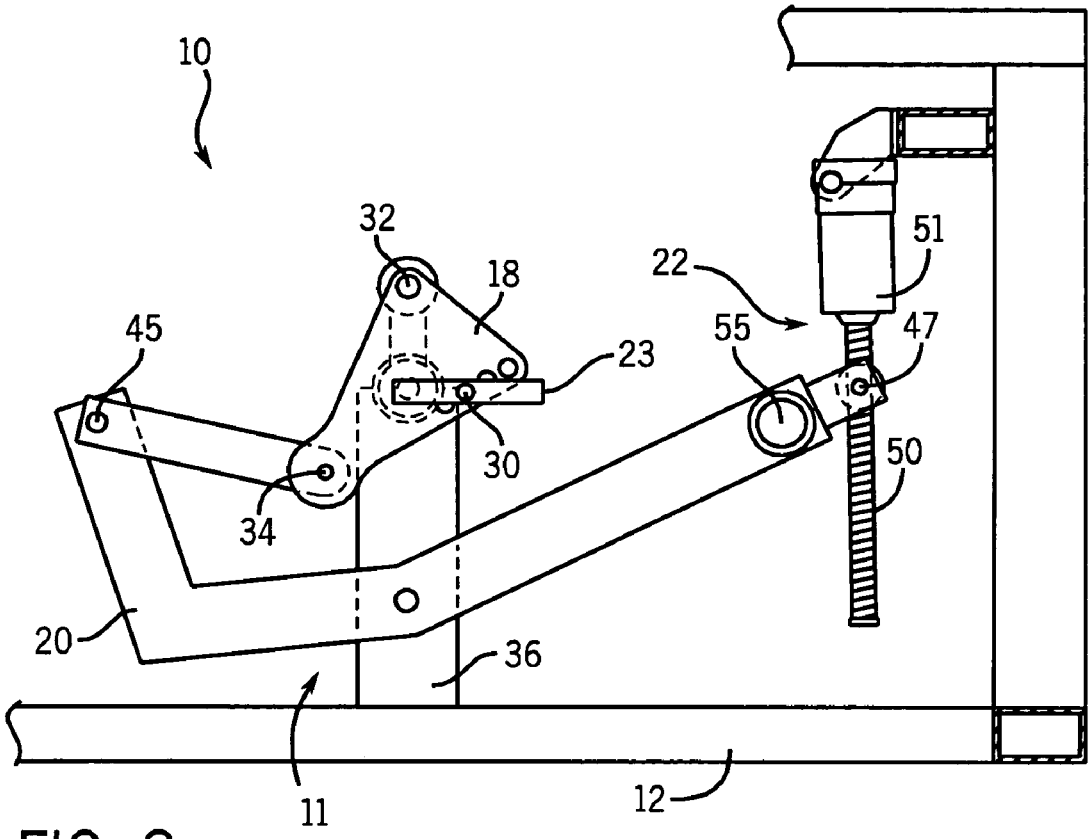
FIG. 8 is an elevated side view of the device of FIG. 1 in a different orientation with certain elements omitted for ease of reference.
Figure 9B:
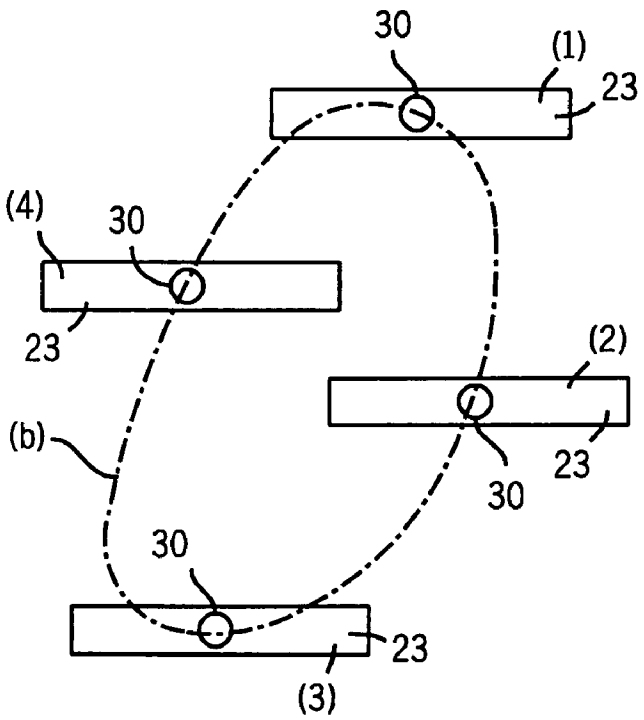
FIGS. 9*a* and 9*b* are schematic side views of the device of FIG. 1 showing two exemplary paths of travel of the footpads.
Figure 9A:
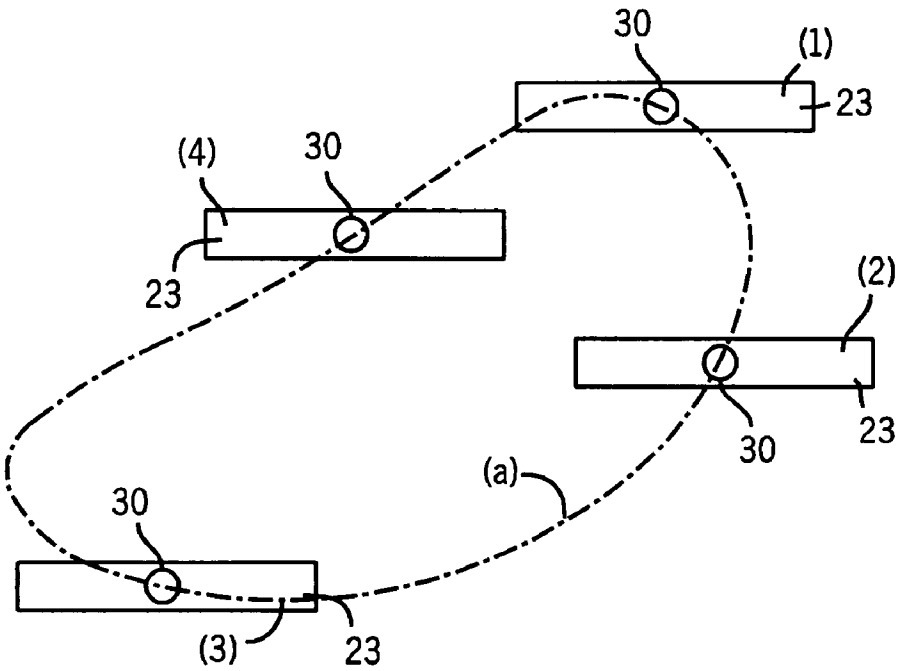

Referring to FIGS. 4-7, the threaded collar 47 is positioned at the low end of its operating range and the lift pivot 45 is oriented near the uppermost position. This results in a shallower, longer generally elliptical path (a) seen in the schematic side view of the path of travel of the footpads 23 in FIG. 9*a*, wherein the angle of the major dimension of the generally elliptical path with respect to horizontal is approximately thirty degrees (30°). In FIG. 8, the threaded collar 47 is positioned at the upper end of its operating range and the lift pivot 45 is oriented near the lowermost position. This results in a steeper, shorter generally elliptical path (b) seen in the schematic side view of the path of travel of the footpads 23 in FIG. 9*b*, wherein the angle of the major dimension of the generally elliptical path with respect to horizontal is approximately seventy degrees (70°).

Figure 10:
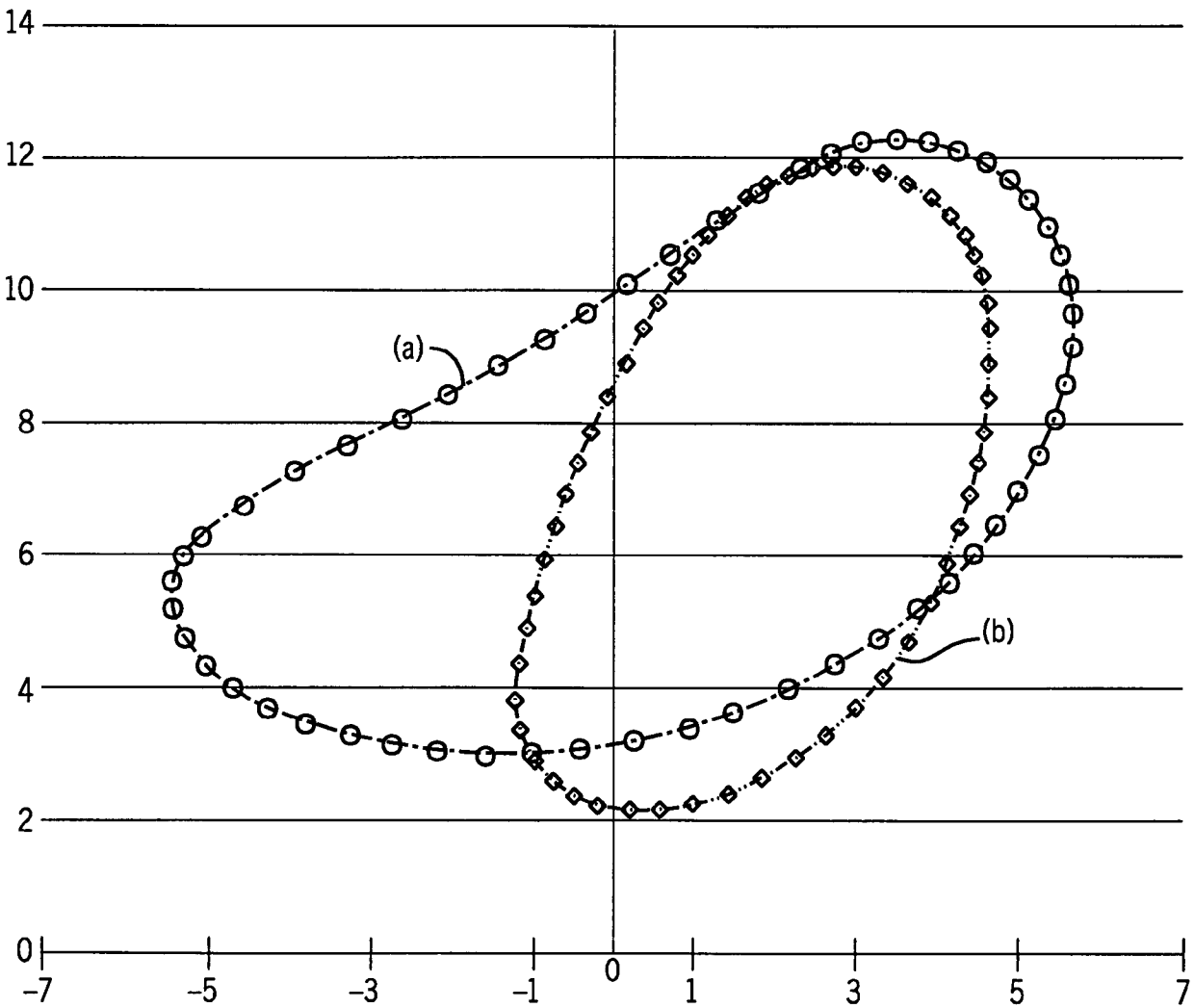
FIG. 10 is a schematic graph of the device of FIG. 1 showing two exemplary paths of travel of the footpads.

In one embodiment, the lift mechanism 22 can be adjusted to produce a generally vertically inclined, elliptical path having a major or longitudinal dimension forming an angle within the range of about thirty degrees (30°) to about seventy-five degrees (75°) from horizontal, and the length of the generally elliptical path (or stride) can be adjusted within the range of approximately ten (10) inches to approximately eighteen (18) inches. In a further preferred embodiment, the lift mechanism 22 produce a generally vertically inclined, elliptical path having a major or longitudinal dimension forming an angle within the range of about fifty degrees (50°) to about seventy-five degrees (75°) from horizontal, and the length of stride can be about ten (10) inches to about fifteen (15) inches. In another preferred embodiment, the lift mechanism 22 produce a generally vertically inclined, elliptical path having a major or longitudinal dimension forming an angle within the range of about sixty degrees (60°) to about seventy-five degrees (75°) from horizontal, and the length of stride can be about ten (10) inches to about thirteen (13) inches. Referring also to FIG. 10, a schematic graph of the device of FIG. 1 showing the path of travel (a) of the footpads of FIGS. 4-7 and showing the path of travel (b) of the footpads of FIG. 8 is seen.

Referring to FIGS. 2 and 3, the exercise device 10 further includes a cross-member 55 operably connected between each positioning link 20. The cross-member 55 synchronizes the movement of one lift pivot 45 with the other lift pivot 45. Accordingly, a single lift mechanism 22 can be used to adjust the pair of four-bar linkage assemblies 11.

Referring back to FIGS. 1-3, the load application assembly 24 of the exercise device 10 is shown in greater detail. The transverse axle 38 of each four-bar linkage assembly 11 can be preferably operatively connected to a flywheel 41. The load application assembly 24 applies a braking or retarding force on the rotation of the transverse axle 38. The flywheel 41 can be connected to an axle 61 via a V-belt 63 held taut by an idler gear 65. The axle 61 can be anti-frictionally mounted to a support 73 by a bearing assembly. The transverse axle 61 provides a connection between the right flywheel 41 and the left flywheel 41 (best seen in FIG. 2). The axle 61 can be secured to a step-up pulley 67. The step-up pulley 67 drives a stub shaft 71 via a belt 69. Thus, the flywheel 41 in combination with the step-up pulley 67 provides inertia to the movements of the footpads 23. In addition, the connection of the transverse axle 61 to the transverse axle 38 by the V-belt 63 synchronizes movement between the right footpad and the left footpad. Alternatively, this synchronization could be achieved by use of a cogged timing belt, a chain or gears.

In one embodiment, the load application assembly 24 can comprise a generator 72 used to provide resistance or braking to the exercise device as well as to generate power for use by the system electronics, including, for example, the display panel 74. In addition, the generator 72 contributes further inertia to the inertia supplied by the flywheel 41 in combination with the step-up pulley 67. In another embodiment, the load application assembly 24 can comprise an eddy current brake assembly. The eddy current brake assembly can include a solid metallic disk mounted on the stub shaft 71 to also rotate with the stub shaft 71. Ideally, an annular faceplate of highly electrically conductive material, e.g., copper, can be mounted on the face of the solid disk. A pair of magnet assemblies can be mounted closely adjacent the face of the solid disk opposite the annular plate. The magnet assemblies each include a central core in the form of a bar magnet surrounded by a coil assembly. The magnet assemblies can be positioned along the outer perimeter portion of the disk in alignment with the annular plate.

The location of the magnet assemblies may be adjusted relative to the adjacent face of the disk so as to be positioned as closely as possible to the disk without actually touching or interfering with the rotation of the disk. The difference in size between the diameters of the step-up pulley 67 and the stub shaft 71 results in a substantial step up in rotational speed of the disk relative to the rotational speed of the transverse axle 38. The rotational speed of the disk is thereby sufficient to produce relatively high levels of braking torque through the eddy current brake assembly 72. Alternative braking or retarding forces can be used such as for example friction brakes, fluid resistance, etc.

A flywheel resistance control can be provided that controls the load application assembly 24. The flywheel resistance can be transmitted to the CPU through an analog to digital interface and controller and to the display panel 74 for ease of viewing for a user of the device. In a further preferred embodiment, the system for applying a braking or retarding force can be located forward relative to the transverse axle 38 to minimize the footprint of the exercise device.

Thus, in use, the user selects the angle and the stride length of the generally elliptical path of the footpads by adjusting the lift mechanism. The user positions him/her self on the footpads 23. The user can begin, for example, with the footpads 23 in the position generally shown in FIG. 4; this footpad position is seen in FIG. 9 as position (1). Upon exerting weight on the footpad 23, the footpad 23 travels downwardly in a generally elliptical motion to the position seen in FIG. 5; this footpad position is seen in FIG. 9 as position (2). With the user continuing to exert weight on the footpad 23, the footpad travels downwardly and rearwardly in a generally elliptical motion to the position seen in FIG. 6; this footpad position is seen in FIG. 9 as position (3). With the inertia from the motion from position (2) to position (3) combined with the user exerting weight on the additional footpad (not shown), the footpad 23 travels upwardly and forwardly in a generally elliptical motion to the position seen in FIG. 7; this footpad position is seen in FIG. 9 as position (4). From this position, the cycle then repeats itself; of course, the user can begin the cycle from any position of the footpad 23.

Referring to FIG. 10, a schematic graph of the device of FIG. 1 showing two exemplary paths of travel of the footpads. In a first path (a), the lift assembly is in a relatively upper position while in a second path (b), the lift mechanism is in a relatively lower position; of course, a virtually limitless number of additional footpaths can be employed by adjusting the lift mechanism. In the first path (a), the circles designate an equal time interval on the generally elliptical path; likewise, in the second path (b), the diamonds designate an equal time interval on the generally elliptical path. Thus, it is seen that the footpads travel relatively quickly through the generally flat portions of the generally elliptical paths while the footpaths travel relatively slower through the generally arc potion of the generally elliptical path. This helps to increase the Relative Perceived Exertion (RPE) of a user on the exercise device. In particular, the rate of travel of the footpad 23 on the upper or generally flat portion of the footpath is greater than the rate of travel of the footpad 23 at other locations about its path of travel. This is evident by the relative distance separating points in the path of the footpad as the main crank arm 14 rotates about the first pivot axis 26.

This variable rate of travel of the footpad through its path of travel generally replicates the natural motion of a user's foot and ankle when walking, jogging or stepping. When walking, jogging or stepping, the foot that is not in contact with the ground travels a greater distance over a fixed time interval than the foot that is in contact with the ground. The exercise device 10 of the present invention therefore advantageously produces a foot motion that not only can be adjusted to match the desired motion of the user, but also causes the user's feet to move in a manner that more accurately reflects natural walking, jogging or stepping motions.

Thus, an exercise device in accordance with the principles of the present invention provides the user with a smooth natural action, exercising a relatively large number of muscles through a large range of motion and providing a relatively higher Relative Perceived Exertion (RPE) relative to the elliptical machines of the prior art.

While preferred embodiments of the present invention have been illustrated and described, it would be appreciated that various changes may be made thereto without departing from the spirit and scope of the present invention.

What is claimed is:

1. An exercise device comprising:

a frame;

a pair of foot supports including a first foot support and a second foot support;

at least one four-bar linkage assembly coupled to the frame; the at least one linkage assembly coupled to at least one of the foot supports, the at least one four-bar linkage assembly directing the foot support in a generally elliptical motion while in use, the generally elliptical motion defining a major dimension that extends at an angle from horizontal that is within the range of about thirty degrees (30°) to about seventy-five degrees (75°) and the major dimension having a length that is within the range of about 10 inches to about 18 inches;

a lift mechanism coupled to the at least one four bar linkage assembly that is configured to alter the angle, and the length, of the major dimension of the generally elliptical motion to adjustably alter the shape of the elliptical path of the foot supports; and a positioning link provided as part of the at least one four bar linkage assembly, wherein the positioning link is pivotally coupled to the frame and operably coupled to the lift mechanism, wherein the four-bar linkage assembly comprises a main crank arm; a secondary crank arm; and a foot link, wherein the foot link is pivotally connected to the first foot support, and where the foot link is pivotally connected to the main and secondary crank arms, wherein the first foot support is cantilevered from the foot link.

2. The exercise device of claim 1 further including a flywheel operatively coupled to at least one of the foot supports.

3. The exercise device of claim 2 wherein first and second flywheels are operatively coupled to the first foot support and the second foot support.

4. The exercise device of claim 1 further including a resistance device operatively coupled to the foot supports.

5. The exercise device of claim 1, wherein the major dimension extends at an angle from horizontal that is within the range of about fifty degrees (50°)to about seventy-five degrees (75°)and the major dimension having a length that is within the range of about 10 inches to about 15 inches.

6. The exercise device of claim 1, wherein the major dimension extends at an angle from horizontal that is within the range of about sixty degrees (60°)to about seventy-five degrees (75°).

7. The exercise device of claim 1 further including an arm support for grasping by a user.

8. An exercise device comprising:

a main frame;

a main crank arm coupled to the frame;

a secondary crank arm;

a connecting link pivotally connected to a foot supporting portion at a first pivotal connection, the connecting link further pivotally connecting the main crank arm and the secondary crank arm at second and third pivotal connections, respectively;

a foot support pivotally connected to the connecting link and cantilevered from the connecting link;

an end of the secondary crank arm opposite the third pivotal connection establishing a ground point connection to the main frame; and a lift arm connected to the ground point of the secondary crank arm, the lift arm being further connected to a lift actuator such that as the lift actuator is enabled, the location of the ground point of the secondary crank arm changes.

9. The exercise device of claim 8, wherein the first, second and third pivotal connections are coplanar.

10. The exercise device of claim 8, wherein the second and third pivotal connections are collinear, and wherein the first pivotal connection is spaced apart from the line formed by the collinear second and third pivotal connections.

11. The exercise device of claim 8 further including an arm support for grasping by a user.

12. The exercise device of claim 11 further including a display panel mounted on one of the frame and the arm support, and wherein the orientation of the display panel is easily viewable to a user.

13. The exercise device of claim 8 further including at least one flywheel operatively coupled to the foot-supporting portion.

14. The exercise device of claim 8 further including a resistance application assembly operatively coupled to the foot supporting portion.

15. The exercise device of claim 8 wherein the foot supporting portion travels in a generally elliptical motion while in use, wherein the generally elliptical motion defines a major dimension that extends at an angle from horizontal that is within the range of about thirty degrees (30°) to about seventy-five degrees (75°) and wherein the major dimension has a length that is within the range of about 10 inches to about 18 inches.

16. The exercise device of claim 15, wherein the major dimension extends at an angle from horizontal that is within the range of about fifty degrees (50°) to about seventy-five degrees (75°) and the major dimension having a length that is within the range of about 10 inches to about 15 inches.

17. The exercise device of claim 15, wherein the major dimension extends at an angle from horizontal that is within the range of about sixty degrees (60°) to about seventy-five degrees (75°).

18. The exercise device of claim 1, wherein the foot link is pivotally connected to the foot support about an axis and wherein the foot support outwardly extends from the foot link in a direction parallel to the axis.

19. An exercise device comprising:

a main frame;

a main crank arm coupled to the frame;

a secondary crank arm;

a connecting link pivotally connected to a foot supporting portion at a first pivotal connection, the connecting link further pivotally connecting the main crank arm and the secondary crank arm at second and third pivotal connections, respectively;

an end of the secondary crank arm opposite the second pivotal connection establishing a ground point connection to the main frame; and a lift arm connected to the ground point of the secondary crank arm, the lift arm being further connected to a lift actuator such that as the lift actuator is enabled, the location of the ground point of the secondary crank arm changes, wherein the second and third pivotal connections are collinear, and wherein the first pivotal connection is spaced apart from the line formed by the collinear second and third pivotal connections.

* * * * *